United States Patent [19]

Gunderson et al.

[11] Patent Number: 5,069,351

[45] Date of Patent: Dec. 3, 1991

[54] INFANT NURSING APPARATUS

[76] Inventors: Thomas Gunderson; Barbara A. Gunderson, both of 9600 Xylon Ave. S., Bloomington, Minn. 55438

[21] Appl. No.: 622,626

[22] Filed: Dec. 5, 1990

[51] Int. Cl.[5] ..... A61J 9/06; A61J 9/08

[52] U.S. Cl. ..... 215/11.1; 215/36.5; 215/11.6; 215/13.1

[58] Field of Search ..... 215/11.1–11.6, 215/13.1, 36.5, 12.1; D24/47

[56] References Cited

U.S. PATENT DOCUMENTS

| | | | |
|---|---|---|---|
| D. 298,354 | 11/1988 | Viator | D24/47 |
| 2,096,961 | 10/1937 | Condon | 215/11.6 |
| 2,480.247 | 8/1949 | Jamison et al. | 215/11.6 |
| 2,837,232 | 6/1958 | Rossi | 215/13.1 |
| 2,864,520 | 12/1958 | Pitauy | 215/11.1 |
| 2,926.805 | 3/1960 | Mead | 215/11.1 |
| 3,308.980 | 3/1967 | Taylor | 215/13.1 |
| 3,746,198 | 7/1973 | Howland | 215/11.6 X |
| 4,600.111 | 7/1986 | Brown | 215/13.1 X |
| 4,778,068 | 10/1988 | Kohus | 215/11.1 |
| 4,789,073 | 12/1988 | Fine | 215/13.1 |

FOREIGN PATENT DOCUMENTS

| | | | |
|---|---|---|---|
| 163233 | 6/1949 | Austria | 215/11.2 |
| 591805 | 7/1925 | France | 215/11.6 |
| 967535 | 11/1950 | France | 215/11.6 |
| 1103010 | 10/1955 | France | 215/11.6 |
| 2154451 | 9/1985 | United Kingdom | 215/11.4 |

*Primary Examiner*—Sue A. Weaver
*Attorney, Agent, or Firm*—Leon Gilden

[57] ABSTRACT

An apparatus including an inner container rotatably mounted within an outer container and axially positioned medially therewithin to secure a flexible sheet of indicia between the inner and outer containers. A weaning cap or a nursing nipple is threadedly secured to the inner container containing a nursing fluid therewithin. A cover skirt, or selectively a cap, is mounted overlying the nursing nipple, weaning cap, or inner container respectively.

4 Claims, 5 Drawing Sheets

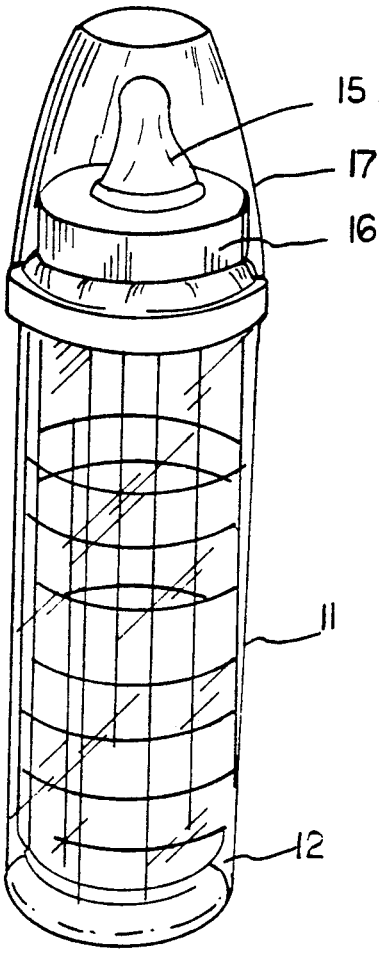
FIG 3
FIG 4
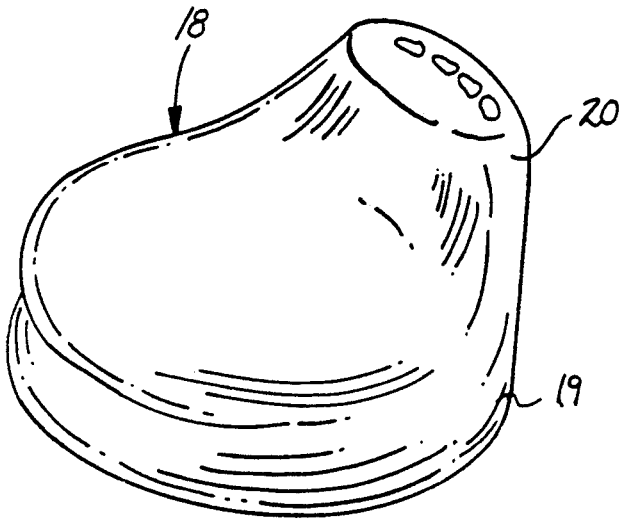

INFANT NURSING APPARATUS

BACKGROUND OF THE INVENTION

1. Field of the Invention

The field of invention relates to nursing apparatus for infants, and more particularly pertains to a new and improved infant nursing apparatus wherein the same is arranged for providing an insulation barrier, as well as a message containing space and message between an inner and outer container. The weaning cap, made of rigid-like material, with appertures aligned axially, or internally threaded to rotatably mount an associated cylinder.

2. Description of the Prior Art

Various nursing apparatus have been used in the prior art to effect nursing of infants and the like. The instant invention attempts to overcome deficiencies of the prior art by permitting an individual to insert a flexible sheet containing information and the like thereon relative to a nursing event. Examples of the prior art include U.S. Pat. No. Des. 251,612 to Lagergren wherein a transparent nursing bottle contains an upper and a lower chamber.

U.S. Pat. No. 4,778,068 to Kohus sets forth a baby feeding bottle wherein the bottle is convertible from various capacities for use in a nursing event.

U.S. Pat. No. Des. 298,354 to Viator sets forth a baby bottle defined by a narrowed central portion to define a generally hour glass type configuration.

U.S. Pat. No. 3,746,198 to Howland sets forth a disposable baby bottle wherein the container is disposed of goods subsequent to its use.

U.S. Pat. No. 2,926,805 to Mead provides an infant nursing bottle containing a series of projections on an exterior surface thereof for amusement and enhanced grasping of the bottle during use.

As such, it may be appreciated that there continues to be a need for a new and improved infant nursing apparatus as set forth by the instant invention which addresses both the problems of ease of use and cleaning as well as effectiveness in a system for effecting nursing and weaning and providing information for a nursing event and in this respect, the present invention substantially fulfills this need.

SUMMARY OF THE INVENTION

In view of the foregoing disadvantages inherent in the known types of infant nursing apparatus now present in the prior art, the present invention provides an infant nursing apparatus wherein the same provides for an inner container coaxially mounted within an outer container, with the inner container including an upwardly projecting threaded portion for reception of various nursing caps or weaning cap thereon, with the inner and outer containers providing an insulating space and message containing chamber containing a message therebetween to provide information relating to a nursing event. As such, the general purpose of the present invention, which will be described subsequently in greater detail, is to provide a new and improved infant nursing apparatus which has all the advantages of the prior art infant nursing apparatus and none of the disadvantages.

To attain this, the present invention provides an apparatus including an inner container rotatably mounted within an outer container and axially positioned medially therewithin to secure a flexible sheet of indicia between the inner and outer containers. A weaning cap or a nursing nipple is threadedly secured to the inner container containing a nursing fluid therewithin. A cover skirt, or selectively a cap, is mounted overlying the nipple or inner container respectively.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant nursing apparatus which has all the advantages of the prior art infant nursing apparatus and none of the disadvantages.

It is another object of the present invention to provide a new and improved infant nursing apparatus which may be easily and efficiently manufactured and marketed.

It is a further object of the present invention to provide a new and improved infant nursing apparatus which is of a durable and reliable construction.

An even further object of the present invention is to provide a new and improved infant nursing apparatus which is susceptible of a low cost of manufacture with regard to both materials and labor, and which accordingly is then susceptible of low prices of sale to the consuming public, thereby making such infant nursing apparatus economically available to the buying public.

Still yet another object of the present invention is to provide a new and improved infant nursing apparatus which provides in the apparatuses and methods of the prior art some of the advantages thereof, while simultaneously overcoming some of the disadvantages normally associated therewith.

Still another object of the present invention is to provide a new and improved infant nursing apparatus wherein the same is arranged to contain messages regarding a nursing event.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 13 is an orthographic side view, taken in elevation, of a cover cap utilized to overlie a nipple member utilized by the instant invention.

FIG. 14 is an orthographic cross-sectional illustration of the cap as set forth in FIG. 13.

FIG. 15 is an orthographic bottom view of the cap as set forth in FIG. 13.

DESCRIPTION OF THE PREFERRED EMBODIMENT

Figure 2:
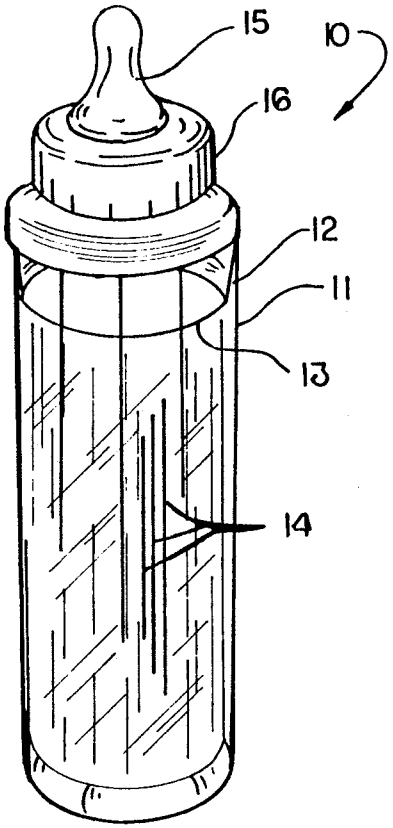
FIG. 2 is an isometric illustration of the instant invention.

With reference now to the drawings, and in particular to FIGS. 1 to 15 thereof, a new and improved infant nursing apparatus embodying the principles and concepts of the present invention and generally designated by the reference numeral 10 will be described.

Figure 1:
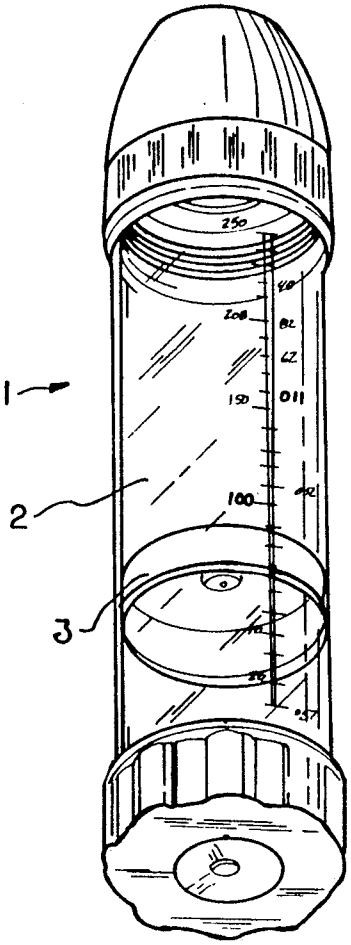
FIG. 1 PRIOR ART
FIG. 1 is an isometric illustration of a prior art nursing bottle.

FIG. 1 illustrates a prior art infant nursing bottle structure 1 containing a bottle 2, with a medially positioned member 3 therebetween and defined with an upper and lower chamber, as illustrated and set forth in U.S. Pat. No. Des. 251,612.

Figure 3:
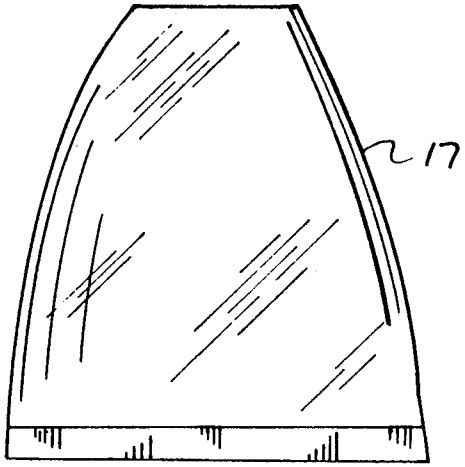
FIG. 3 is an isometric illustration of the instant invention with the message sheet removed therefrom.
Figure 5:
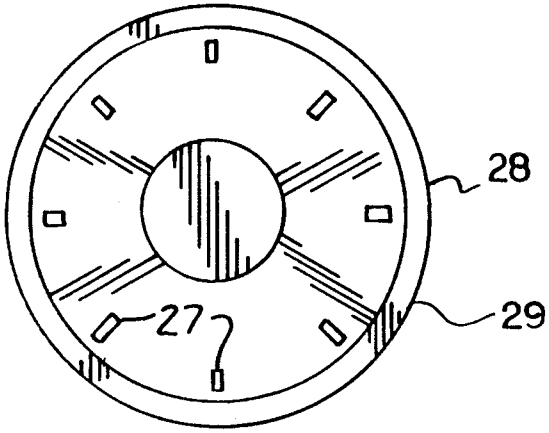

More specifically, the infant nursing apparatus 10 of the instant invention essentially comprises an outer transparent container 11 coaxially aligned mounting an inner container 12 of transparent construction, with an inner container 12 defined by a second diameter less than a first diameter defined by the outer container and measured at a common point when the inner and outer containers 11 and 12 are in a similar configuration, as illustrated in FIG. 2 for example. A flexible sheet 13 is positionable accordingly within insulating chamber defined between the inner and outer containers when they are in a similar configuration, with a flexible sheet 13 including indicia 14 imprinted thereon for providing information regarding a nursing event, such as information related to baby's name, time of nursing, quantity of nursing fluid to be provided, and the like. The flexible sheet also allows personalized artistic desings. A nursing nipple 15 is mounted within a nipple cap 16, with the nipple cap 16 defined by a nipple cap diameter. A truncated conical cover 17 is provided and mounted over the nipple cap 16, in a manner as illustrated in FIG. 3 for example. A nursing cap 18 is also provided, including a nursing cap internally threaded skirt 19 selectively securable to the inner container 12 in a manner to be discussed below. An aperture projection 20 is directed above the nursing cap and includes a plurality of apertures through the projection, with the projection 20 aligned with the annular side wall of the nursing cap 18.

Figures 5, 6, 7, 8:
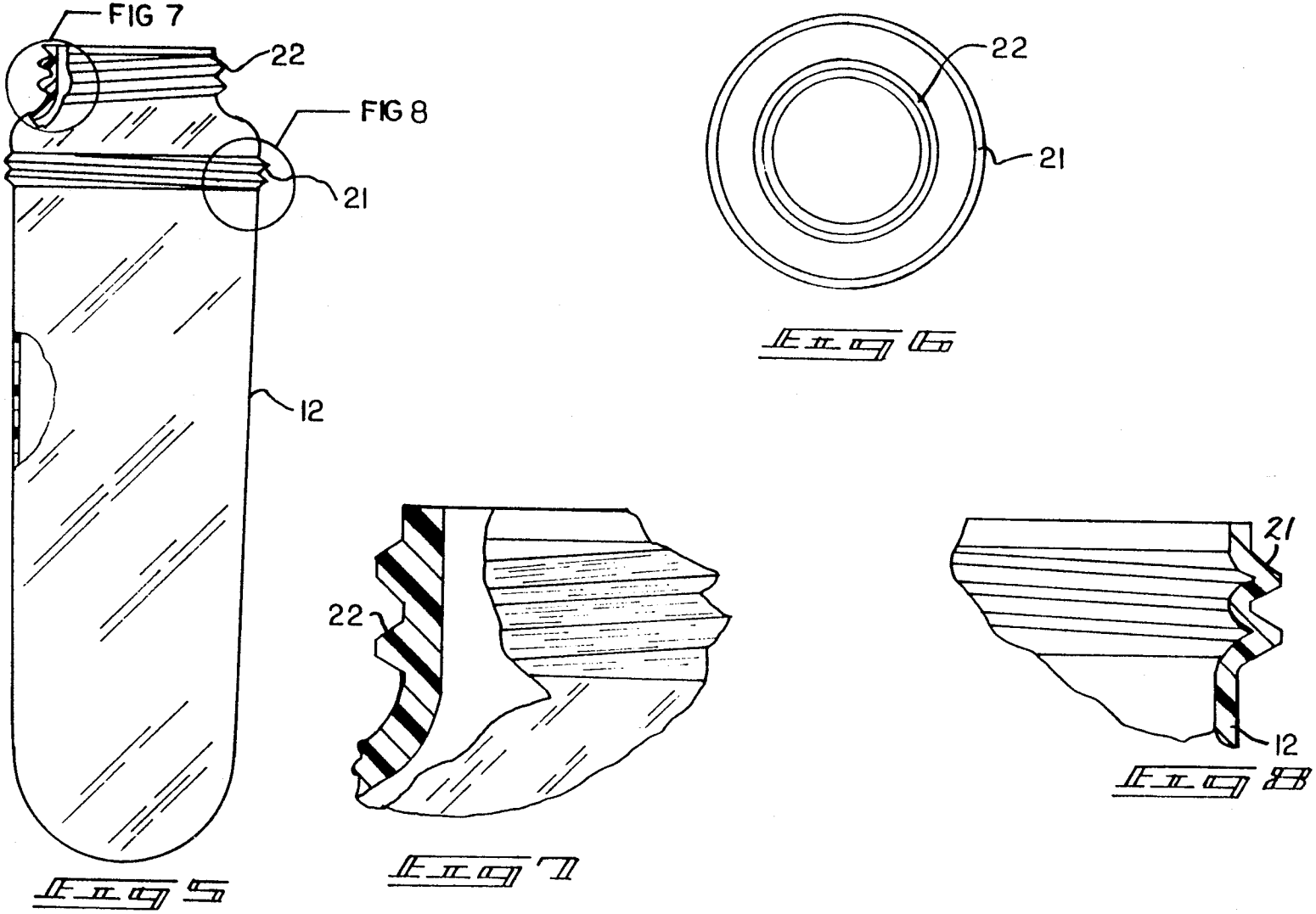
FIG. 5 is an orthographic side view, taken in elevation, of the inner container utilized by the instant invention.
FIG. 6 is an orthographic top view of the inner container as set forth in FIG. 5.
FIG. 7 is an orthographic side view of the inner container portion 7 as set forth in FIG. 5.
FIG. 8 is an orthographic side view of the inner container portion 8 as set forth in FIG. 5.
Figure 11:
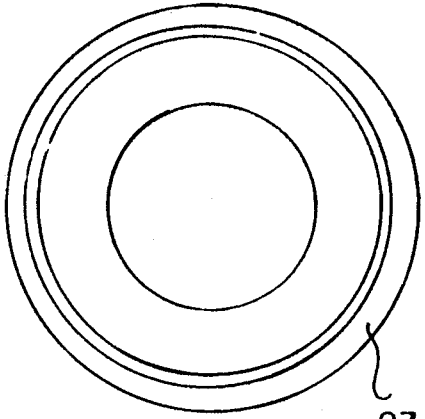
FIG. 11 is an orthographic top view of the outer container as set forth in FIG. 9.
Figure 10:
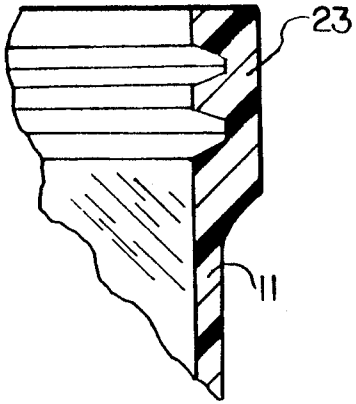
FIG. 10 is an orthographic view of the internally threaded collar of the outer container as set forth in FIG. 9.
Figure 12:
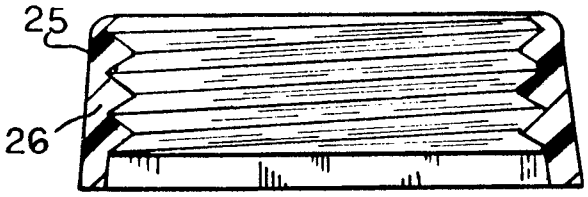
FIG. 12 is an orthographic cross-sectional illustration of a closure cap structure utilized by the instant invention.
Figure 9:
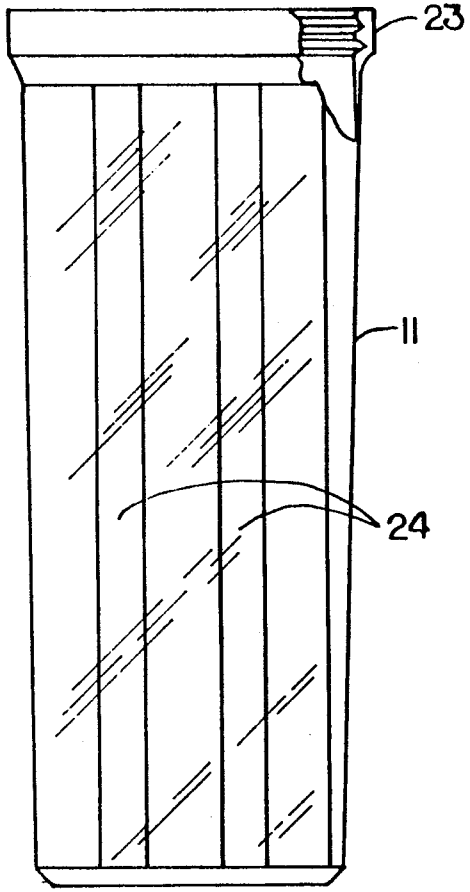
FIG. 9 is an orthographic side view, taken in elevation, of the outer container.
Figure 4:
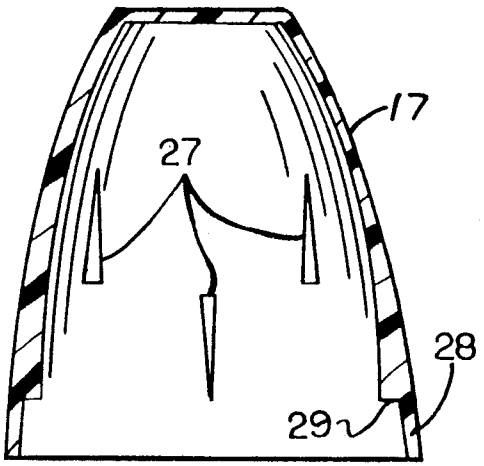
FIG. 4 is an isometric illustration of a weaning cap utilized by the instant invention.

Reference to FIG. 5 illustrates the inner container 12 including a first externally threaded portion 21 defined by a first thread diameter. A second externally threaded portion 22 is defined by a second threaded diameter less than the first threaded diameter, with the second threaded portion 22 mounted upon a spout coaxially projecting above the first threaded portion 21. The first externally threaded portion 21 is complementarily receivable within an internally threaded collar 23 of the outer container 11 (see FIG. 9). Further, the outer container 11 includes a series of grasping flutes 24 that are arranged about the outer surface of the outer container longitudinally thereof in a spaced relationship to enhance securement of the outer container and an organization in a nursing event. Further, the inner container 5 includes a semi-spherical bottom to enhance cleaning of the fluid containing portion of the apparatus.

A closure cap 25 is also provided, including an internally threaded skirt 26 defined by the second threaded diameter to receive the second threaded portion 22 therewithin to permit closure of the inner container during intervals of infant feeding.

The truncated conical cover 17, as illustrated in FIG. 13, includes reinforcing ribs 27 positioned interiorly thereof to provide structural integrity to the organization resisting impact of the conical cover 17. A nipple cap skirt 28 is defined about a lower terminal end of the conical cover 17 and is defined by an internal skirt diameter substantially equal to the nipple cap diameter of the nipple cap 16. An annular abutment surface 29 is orthogonally oriented relative to an axis defined by the conical cover 17 to receive an upper surface of the nipple cap 16 therewithin and seat the conical cover 17 upon the nipple cap in a frictional relationship.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An infant nursing apparatus comprising, in combination, an outer container mounting an inner container therewithin, the inner and outer containers are coaxially aligned in an assembled configuration along a common axis, and a nursing means securably mounted to the inner container for effecting nursing of an infant, and a cover member including a lower end portion with means for frictional securement to the nursing means, and wherein the inner container is defined by a first diameter and the outer container is defined by a second diameter, wherein the second diameter is greater than the first diameter as measured at a common point along the common axis, and the inner container includes a main body portion with a first externally threaded portion defined by a first threaded diameter from the upper terminal end of the body portion, and the outer container including an internally threaded collar having an internal diameter equal to the first threaded diameter to permit selective securement of the first externally threaded portion within the internally threaded collar, and a spout coaxially projecting above the first externally threaded portion, with the spout including a second externally threaded portion defined by a second threaded diameter, wherein the second threaded diameter is less than the first threaded diameter, and the nursing means is selectively securable to the second externally threaded portion, and including a flexible sheet, the flexible sheet includes indicia thereon relative to the nursing event, wherein the flexible sheet is positioned in an enclosed chamber formed between the inner container and the outer container, and the inner and outer containers are transparent.

2. An apparatus as set forth in claim 1 wherein the outer container includes a series of spaced grasping flutes formed about the outer container coaxially thereof to enhance grasping of the outer container during use.

3. An apparatus as set forth in claim 2 wherein the cover member includes a downwardly projecting annular nipple cap skirt, with the cap skirt including an annular abutment surface interiorly thereof, wherein the abutment surface is arranged orthogonally relative to an axis defined by the cover member, and the nipple cap skirt has an internal skirt diameter substantially equal to an external diameter defined by the nursing means to form the means for frictional securement of the nursing means within the nipple cap skirt, and a plurality of reinforcing ribs mounted interiorly of the cover member to enhance structural integrity of the cover member.

4. An apparatus as set forth in claim 3 wherein the nursing means includes a closure cap, wherein the closure cap includes an internally threaded skirt, wherein the internally threaded skirt is defined by an internal diameter equal to the second threaded diameter for selective securement to the second externally threaded portion to effect closure of the inner container prior to a nursing event, and further including a weaning cap, wherein the weaning cap includes a series of apertures formed within a projection, wherein the projection is aligned with an annular side wall of the closure cap.

* * * * *